United States Patent [19]

Friedman et al.

[11] Patent Number: 4,780,647

[45] Date of Patent: Oct. 25, 1988

[54] COMPACT HIGH POWER ACCELERATOR

[75] Inventors: Moshe Friedman, Washington, D.C.; Victor Serlin, Springfield, Va.

[73] Assignee: The United States of America as represented by the Secretary of the Navy, Washington, D.C.

[21] Appl. No.: 86,345

[22] Filed: Aug. 18, 1987

[51] Int. Cl.[4] ..... H01J 25/10

[52] U.S. Cl. ..... 315/5.41; 315/5; 315/5.13; 315/5.15; 315/5.35; 328/228; 328/233; 376/108; 376/127

[58] Field of Search ..... 315/3, 4, 5, 5.11, 5.13, 315/5.14, 5.15, 5.41, 5.42, 5.43, 5.51; 328/228, 233; 332/7, 25, 68; 376/108, 120, 127

[56] References Cited

U.S. PATENT DOCUMENTS

| | | | |
|---|---|---|---|
| 2,813,996 | 11/1957 | Chodrow | 315/5.42 |
| 4,038,602 | 7/1977 | Friedman | 315/5 X |
| 4,215,291 | 7/1980 | Friedman | 315/5.41 |
| 4,583,025 | 4/1986 | Adler et al. | 315/4 |
| 4,656,430 | 4/1987 | Olson | 315/4 X |

OTHER PUBLICATIONS

Foreign Publication, The Wake Field Acceleration Mechanism, by G. A. Voss and T. Weiland, Report No.: DESY-82-074, Nov. 1982, pp. 1-8 plus 12 unnumbered pages of drawings (FIGS. 1-16).

Publication, Particle Accelerators Powered by Modulated Intense Relativistic Electron Beams, by M. Friedman and V. Serlin, Applied Physics Letters 49(10), Sep. 8, 1986, pp. 596-598.

Publication, Collective Acceleration of Electrons Using an Autoacceleration Process, by T. R. Lockner and M. Friedman, Journal of Applied Physics 51(12), Dec. 1980, pp. 6068-6074.

Publication, Autoacceleration of High Power Electron Beams, by M. Friedman, Applied Physics Letters 41(5), Sep. 1, 1982, pp. 419-421.

U.S. application Ser. No. 943,011 filed 12-18-86.

*Primary Examiner*—David K. Moore

*Assistant Examiner*—Mark R. Powell

*Attorney, Agent, or Firm*—Thomas E. McDonnell; George Jameson

[57] ABSTRACT

A system for providing a compact, high power particle accelerator powered by a modulated intense relativistic electron beam. In a preferred embodiment a first source develops a high power intense relativistic electron beam (IREB). A modulating apparatus modulates the IREB with a low power level RF signal to produce a high power MIREB. All of the kinetic energy from the high power MIREB is then stored as a high level of electromagnetic or RF energy in an accelerating apparatus. A particle beam from a source is modulated with the RF signal to establish a phase coherency between the modulated particle beam and the stored RF energy before it is passed through the accelerating apparatus. This phase coherent particle beam is accelerated by the stored RF energy as it drains this energy from the accelerating apparatus during its passage through the accelerating apparatus.

26 Claims, 3 Drawing Sheets

COMPACT HIGH POWER ACCELERATOR

CROSS-REFERENCE TO RELATED APPLICATION

This patent application is related to the co-pending U.S. patent application entitled "Multi-Gigawatt High-Efficiency RF Amplifier," Ser. No. 943,011, filed Dec. 18, 1986, now U.S. Pat. No. 4,757,269, both of which applications being commonly assigned to the Government of the United States.

BACKGROUND OF THE INVENTION

The present invention relates to particle accelerators and particularly to a particle accelerator powered by a modulated intense relativistic electron beam.

Many different types of accelerators have been proposed over the last 50 years or so.

One type of accelerator is called an "autoaccelerator." In an autoaccelerator, part of an intense relativistic electron beam (IREB) induces an electromagnetic field in a coaxial cavity inserted in a drift tube. This electromagnetic field, in turn, interacts with subsequent portions of the same IREB causing an acceleration of electrons in those subsequent portions of the IREB. See *Collective Acceleration of Electrons Using an Autoacceleration Process* by T. R. Lockner and M. Friedman in 51 J. Appl. Phys. 6068–6074 (1980), and *Autoacceleration of High Power Electron Beams* by M. Friedman in 41 Appl. Phys. Lett. 419–421 (1982) for more complete discussions of autoaccelerators.

Another type of accelerator is a proposed wake field accelerator. In such a wake field accelerator two electron beams exchange energy while propagating through the same structure but on different trajectories. The central idea in such an accelerator is to use the wake field, that travels behind a single high-energy bunch of charged particles, to accelerate a low density electron beam. This single bunch has the shape of an annular ring moving down a corrugated drift tube. The wake field produced by this single bunch converges radially along radial transmission lines, establishing an electric field at the center that can be considerably larger than the electric field needed to accelerate the annular ring-shaped bunch. This electric field reaches the center at the same time as the low density electron beam, which is moving axially, causing the low density electron beam to be accelerated.

A third type of accelerator, which is a conventional type of accelerator, is typically an RF (radio frequency) linear accelerator which uses a klystron amplifier. Such klystron amplifiers operate at relatively low output power levels of under 100 megawatts with an efficiency of about 50%. As a result, these typical linear accelerators have to be very large, sometimes three miles in length, in order to accelerate particles to high energy levels.

OBJECTS OF THE INVENTION

One object of the invention is to provide a compact, high power accelerator.

Another object of the invention is to provide a relatively short accelerator which has a relatively high voltage gradient.

Another object of the invention is to provide a simplified accelerator.

A further object of the invention is or provide a particle accelerator that is powered by modulated intense relativistic electron beams.

SUMMARY OF THE INVENTION

These and other objects of this invention are achieved in a preferred embodiment of the invention by providing a system comprised of: an intense relativistic electron beam (IREB) generator for injecting an annular beam into a bunching region, a low level RF source for modulating the IREB to produce a modulated intense relativistic electron beam (MIREB), a cavity containing a structure which causes the RF energy in the MIREB to be stored in the structure, and a particle source which selectively produces a particle beam that traverses and drains the stored energy from the structure and is accelerated by the stored energy as it drains that stored energy from the structure.

BRIEF DESCRIPTION OF THE DRAWINGS

These and other objects, features, and advantages of the invention, as well as the invention itself, will become better understood by reference to the following detailed description when considered in connection with the accompanying drawings wherein like reference numerals designate identical or corresponding parts throughout the several views, and wherein.

DETAILED DESCRIPTION OF THE PREFERRED EMBODIMENT

Figure 1:
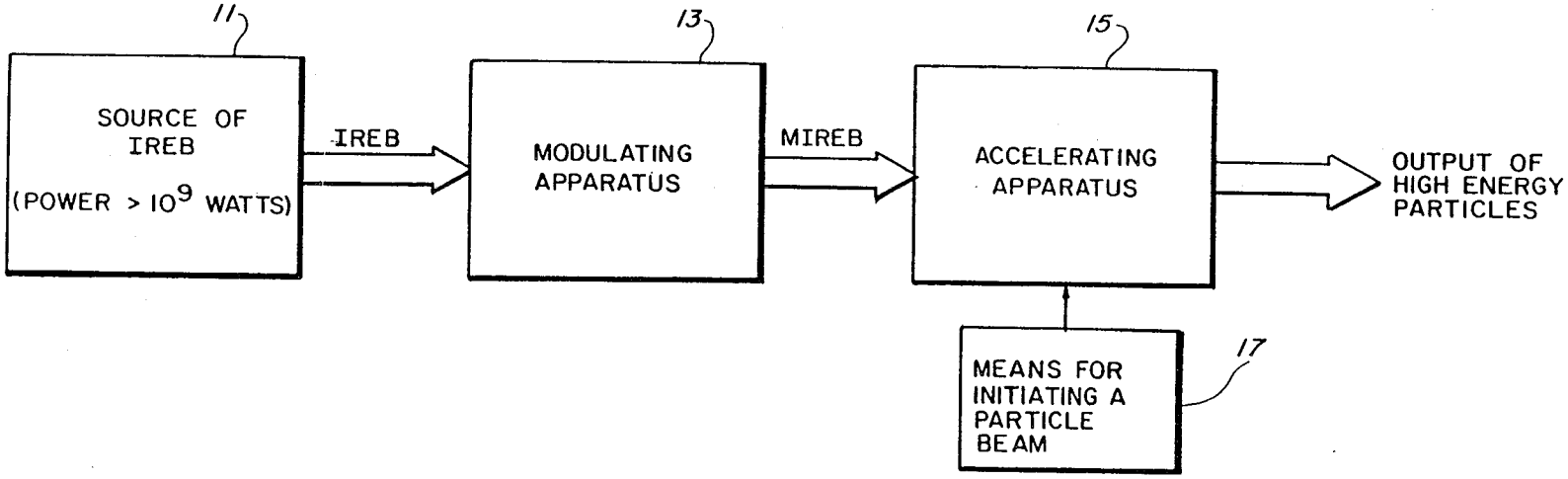
FIG. 1 is a schematic block diagram of the invention.

Referring now to FIG. 1, a basic schematic block diagram of the invention is shown. A source 11 of an intense relativistic electron beam (IREB) selectively produces an IREB pulse when it is energized (to be explained). This IREB pulse can have, for example, a power level of more than 1000 megawatts ($10^9$ watts).

The IREB pulse from source 11 is modulated at a preselected radio frequency (RF) by a modulating apparatus 13 to produce a high power, modulated intense relativistic electron beam (MIREB) in the form of a plurality of bunches of electrons. This MIREB is then applied to an accelerating apparatus 15, which causes substantially all of the RF energy in the high power MIREB to be converted into a high level of electromagnetic energy and stored therewithin.

After a predetermined time, a particle beam initiated by a means 17 for initiating a particle beam is applied to the apparatus 15. This particle beam, which can be comprised of electrons, protons or any other ions, is modulated at the same preselected RF as the IREB pulse (to be explained) in order to establish a phase coherency between the stored electromagnetic energy in the apparatus 15 and the modulated particle beam. The modulated particle beam passes through the accelerating apparatus 15. Since the modulated particle beam is phase coherent with the stored energy in the apparatus 15, the modulated particle beam drains all of the stored energy from the apparatus 15 as it passes through the apparatus 15. This causes all of the particles in the modulated particle beam to be accelerated as they gain energy from the stored energy in the apparatus 15.

Figure 2:
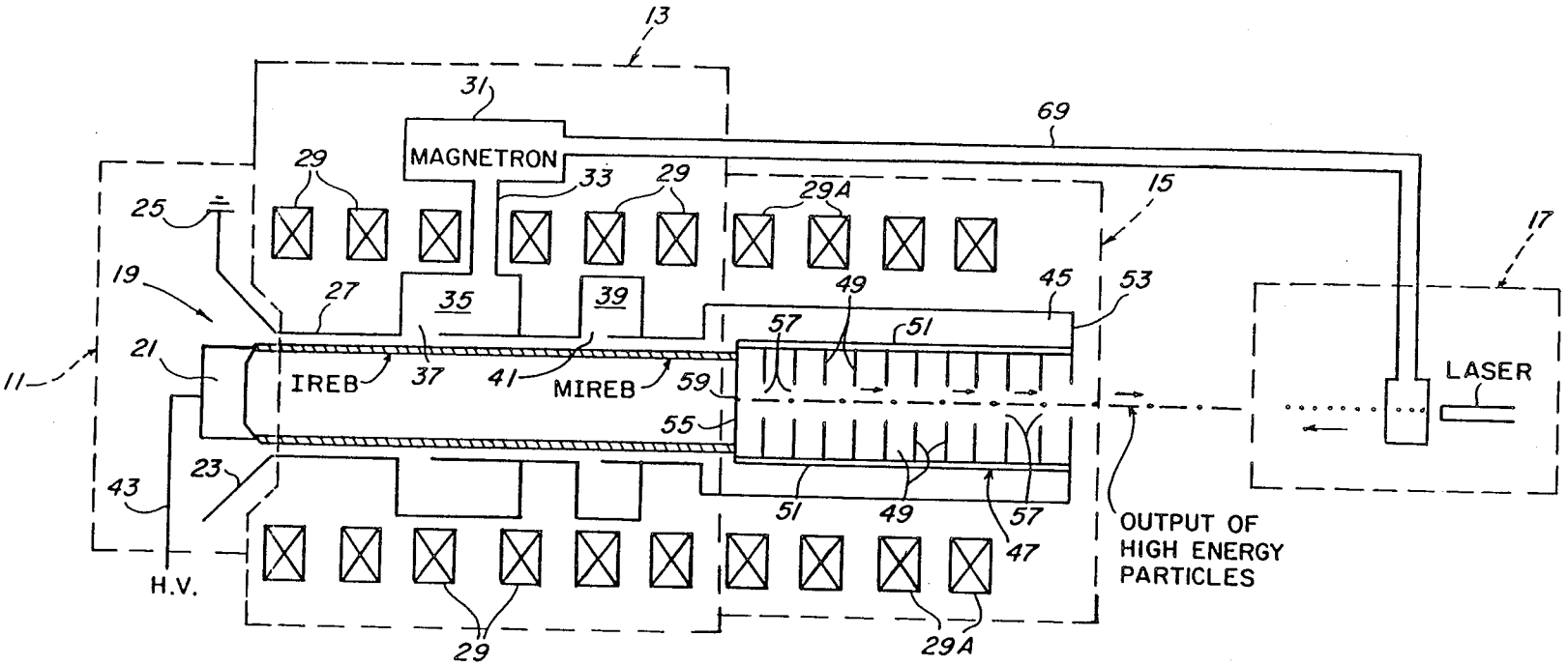
FIG. 2 is a schematic diagram of a preferred embodiment of the invention.

FIG. 2 illustrates a more detailed schematic diagram of the invention of FIG. 1.

As shown in FIG. 2 the source 11 of IREB is a diode 19 having its cathode 21 adapted to receive a high voltage (H.V.) pulse, and its anode 23 connected to a reference or ground potential 25.

The modulating apparatus 13 of FIG. 2 includes an elongated metal drift tube 27, a plurality of magnetic coils 29 surrounding the drift tube 27, an RF source or magnetron 31, a waveguide 33 coupling the RF source 31 to a first annular RF cavity 35 that is coaxial with the drift tube 27, a first circular gap 37 coupling the first cavity 35 to the drift tube 27, a second annular RF cavity 39 that is also coaxial with the drift tube 27, and a second circular gap 41 coupling the second cavity 39 to the drift tube 27.

In operation, the RF source or magnetron 31 transmits RF signal energy through the waveguide 33 and into the first cavity 35 for, for example, a duration of 3 microseconds at a frequency $F=-1328$ megahertz (MHz) and at a 50–100 KW power level. During this 3 microsecond period a Blumlein transmission line 43 applies a high voltage (H.V.) pulse of approximately 1 MV to the cathode 21 for approximately 100 nanoseconds to energize the diode 19.

Upon being energized by this 100 nanosecond H.V. pulse, the diode 19 injects an annular IREB of radius R, voltage V, current I, for a duration T (where, for example, $R=1.9$ centimeters, $V=1$ MV, $I=10$ kA and $T=100$ nanoseconds) into the drift tube 27. As a result, this IREB starts propagating through the drift tube 27. This IREB is confined within the tube 27 by a strong axial magnetic field from the coils 29 around the tube 27.

The RF signal in the cavity 35 produces a signal voltage of approximately 10 kV at the gap 37, which voltage partially modulates the current of the propagating 10 kA IREB. The second cavity 39 is tuned to 1328 MHz (which is the same frequency as that of the RF source 31) and has a characteristic impedance of 45 ohms.

Voltage oscillations of an amplitude $\geqq 120$ kV are induced at the gap 41 of the second cavity 39 when the partially modulated IREB (that emerged from the first cavity 35) traverses the second cavity 39. These voltage oscillations further modulate the partially modulated IREB. The IREB emerging from the second cavity 39 is more than 80% modulated at the frequency of 1328 MHz. Electron beam (IREB) modulation up to 200% can be obtained in this manner. The modulated intense relativistic electron beam (MIREB) propagates through the remaining part of the drift tube 27 to the accelerating apparatus 15.

By comparing the RF power at the gap 37 (50–100 kW) with the IREB power from the diode 19 ($10_9$ watts), it can be seen that the RF source 31 modulates an IREB that is $10^4-10^5$ times higher in power than its own power output. This produces a multi-gigawatt MIREB.

The IREB modulation frequency can go up to 10 gigahertz (GHz) and be amplified with similar gain and power levels by using RF power sources other than the magnetron used at the frequency $F=1328$ MHz.

Thus, the high power IREB (e.g., $10^9$ watts) is modulated by a relatively low power RF signal (e.g., 50–100 kW) to produce a high power (e.g., $10^9$ watts) MIREB capable of operating in a frequency range up to 10 GHz.

A more complete explanation of the modulating apparatus 13 can be found in the above-noted U.S. patent application Ser. No. 943,011, which application is herein incorporated by reference.

The modulated annular electron beam or MIREB is guided by the axial magnetic field, produced by the coils 29 around tube 27, into a cylindrical cavity 45 of the accelerating apparatus 15. To further explain the apparatus 15, both of FIGS. 2 and 3 will be referred to.

Figure 3:
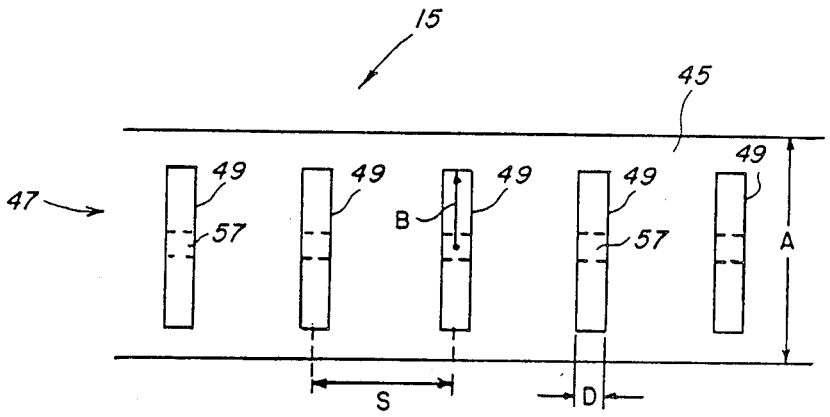
FIG. 3 illustrates exemplary parameters of plates in the structure of FIG. 2.

The cavity 45 has an internal diameter A (FIG. 3). Cavity 45 is loaded with a structure 47 that is comprised of a plurality of thin metallic discs or plates 49 of radius B and thickness D. These discs 49 are spaced along the cavity 45 with a center-to-center separation S between adjacent discs 49. The discs 49 are supported longitudinally by thin metallic rods 51, counterlevered from an end wall 53 of the cavity 45.

It should be noted that, although only 12 discs 49 are shown in FIG. 2, the number of discs or plates 49 is not important for this explanation. The number of discs 49 being used depends upon the particular application of the accelerator of FIG. 2. For example, there can be 10, 100, 500, 1000 or any other number of discs 49, depending on the size and power output requirements of various applications.

The first disc 55 in the cavity 45 of the accelerating apparatus 15 is solid, while the remaining discs 49 have holes 57 located at the centers of the discs 49. As will be explained later, a centrally located point or point source 59 on this first disc 55 operates as the source of the particle beam.

The MIREB from the tube 27 is terminated at this first disc 55. It should be noted at this time that a strong axial magnetic field is supplied by a plurality of magnetic coils 29A, surrounding the cylindrical cavity 45, in order to confine the MIREB within the cavity 45 until after the MIREB is terminated at the first disc 55. When the MIREB is stopped, all of the kinetic RF energy in the MIREB is drained from the MIREB and stored in the form of electromagnetic energy between adjacent one of the plates 55 and 49 in the structure 47 of the apparatus 15. So there is a large amount of energy stored in the apparatus 15.

As discussed before in relation to FIG. 1, the purpose of the modulating apparatus 13 is to develop a MIREB at a high power or energy level, while the purpose of the accelerating apparatus 15 is to utilize the high power or energy in the MIREB to accelerate the particles from the particle beam source 59. It is important to note that the energy in the IREB cannot be directly used to accomplish this purpose of the apparatus 15. The IREB must be modulated and at the right frequency (as determined by the geometric parameters of the apparatus 15) so that, when the MIREB is terminated at the first disc 55 of the structure 47 in the apparatus 15, the kinetic RF energy in the MIREB is drained into and stored in the structure 47 of the apparatus 15.

Therefore, the frequency of modulation for the IREB and the geometry of the cavity 45 are chosen such that a resonance interaction between the MIREB and the cavity 45 occurs, leading to the efficient transfer of energy from the MIREB to the structure 47.

The geometric parameters of the structure 47 and cavity 45 that determine the frequency of modulation are the internal diameter A of the cavity 45, the radius B and thickness D of the discs 49 and the separation S between adjacent discs 49, as shown in FIG. 3. These geometric parameters of the structure 47 and cavity 45 determine the design of the accelerating apparatus 15, which design in turn determines the types of associated dispersion relation curves 61 and 63 in FIG. 4.

The derivation of dispersion relation curves (such as the curves 61 and 63) from the geometric parameters of a structure (such as the structure 47) and its encompassing cavity (such as the cavity 45) is well known in the art and is beyond the purview of this invention. As a result, such derivation will not be further discussed. It is sufficient to know that the geometric parameters of the accelerating apparatus 15 determine the associated pair of dispersion relation curves.

Figure 4:
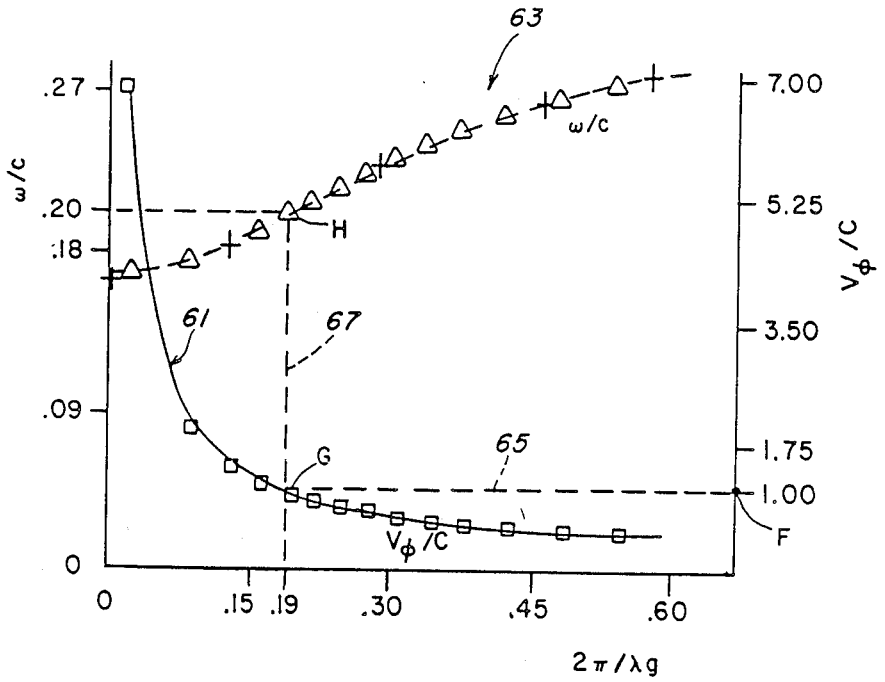
FIG. 4 illustrates the dispersion relation of the structure of FIG. 2.

Referring now to FIG. 4, the dispersion curve 61 is used to determine the relationship between the wavelength ($\lambda_g$) of the RF inside of the accelerating apparatus 15 (by using the coordinate axes) and where $V_\phi/C$, where $V_\phi$ is the phase velocity of the RF. In a similar manner, the dispersion curve 63 is used to determine the required frequency (of modulation in the modulating apparatus 13) by using the coordinate axes $2\pi/\lambda_g$ and $\omega/C$.

To illustrate the use of these curves, assume that a particle moving with the speed of light, C, is to be accelerated. Such a particle could be an electron from the particle beam source 59.

With a speed of light, $V_\phi C=1$. So point F on the vertical axis $V_\phi/C$ would be chosen since its phase velocity value is 1. A horizontal line 65 drawn from point F intersects the curve 61 at point G, determining the wavelength $\lambda_g$ that is needed to obtain a phase velocity=1. Since $2\pi T/=0.19$ at point G' the wavelength $\lambda_g$ can be readily calculated from that equation.

A vertical line 67 drawn from point G on curve 61 intersects the curve 63 at point H, determining the modulating frequency of the IREB (or the frequency of the MIREB). Since $\omega/C=0.20$ at point H and $\omega=2\pi f$, the frequency f can be readily calculated from the equation $2\pi f/C=0.20$.

Thus, if the calculated frequency f is used for the frequency of the MIREB, the RF signal of MIREB will have the correct phase velocity such that it will pick up any particle or electron with the same speed and accelerate it.

Based on the foregoing discussion, it has been shown that the curves 61 and 63 are determined by the geometry of the apparatus 15, and if the frequency calculated from the curves 61 and 63 is used to modulate the IREB, the high energy in the resultant MIREB will be stored in the apparatus 15.

At some predetermined time after the electromagnetic or RF energy (derived from the MIREB) is stored in the apparatus 15, the particle beam source 59 transmits a particle beam. For illustrative purposes a laser is used as the means 17 for initiating a particle beam from point source 59. However, it should be understood that a different means for initiating a particle beam could be used. For example, a spark gap could be used to emit a stream of electrons.

The laser light from the laser 17 is intensity modulated by the RF source 31 via a waveguide 69 so that it is modulated at the same frequency as the IREB was. As a result, the modulated laser light is phase coherent with the electromagnetic energy stored in the apparatus 15.

The modulated laser light traverses the cavity 45 through the holes 5 located at the centers of the discs 49 and illuminates the center of the disc 55 at point 59. By the process of photoemission a second electron beam from point source 59 traverses the cavity 45 through the holes 57 in the discs 49. Since this second electron (or particle) beam is phase coherent with the electromagnetic energy stored in the structure 47, all of the electrons in this second electron beam are accelerated by this stored electromagnetic energy as they drain this energy from the structure 47 in the accelerating apparatus 15.

The higher the energy stored in structure 47, the greater the high voltage gradient in the apparatus 15, and the greater the acceleration of the particle beam from the source 59. Thus, with a very high voltage gradient across the apparatus 15, a very compact and very high power accelerator can be implemented within the purview of this invention. Furthermore, the accelerator of the present invention can be relatively simply implemented, since it does not utilize a klystron and its associated hardware.

Therefore, what has been described is a system which modulates a high power intense relativistic electron beam (IREB) to develop a high power modulated IREB (MIREB). An accelerating apparatus internally stores all of the kinetic energy from the high power MIREB in the form of a high electromagnetic energy. A particle beam from a source is made phase coherent with the frequency of the MIREB. This phase coherent particle beam is then accelerated by the stored high level electromagnetic or RF energy as the particle beam drains this energy from the accelerating apparatus.

It should therefore readily be understood that many modifications and variations of the present invention are possible within the purview of the claimed invention. For example, the particle beam source 59 could emit electrons, protons or any other ions. Also the laser 17 of FIG. 2 could be replaced by another means (even within the structure 45) for initiating a beam of electrons, such as a sparkgap. Furthermore, the laser 17 (when used) does not have to be mounted at the rear of the accelerating apparatus 15 of FIG. 2, but can be mounted off to the side of the accelerating apparatus 15 or at the front of the modulating apparatus 13. Of course, such side or front mounting of the laser may require the disc 55 to be replaced with a disc 49 with a central hole 57 and also may require additional structural elements to cause a beam of electrons to pass from point 59 (FIG. 2) through the structure 47.

What is claimed and desired to be secured by Letters Patent of the United States is:

1. A system comprising:

means for generating a high power intense relativistic electron beam;

means for modulating the intense relativistic electron beam at a preselected frequency to produce a high-power modulated intense relativistic electron beam, said modulating means including a magnetron for providing a modulating signal at said preselected frequency to modulate said intense relativistic electron beam; and means for utilizing the high-power modulated intense relativistic electron beam to accelerate a particle beam.

2. A system comprising:

means for generating a high power intense relativistic electron beam;

means for modulating the intense relativistic electron beam at a preselected frequency to produce a high-power modulated intense relativistic electron beam, said modulating means including radio frequency source means for providing a modulating signal at said preselected frequency to modulate said intense relativistic electron beam;

means for storing the radio frequency energy from the high power modulated intense relativistic electron beam; and means for selectively producing a modulated particle beam that is accelerated by the stored radio frequency energy as said particle beam drains this energy from said storing means.

3. The system of claim 2 wherein said producing means includes:

a laser that produces a light beam that is intensity modulated by said preselected frequency to produce a modulated light beam; and a point source coupled to said storing means and being responsive to said modulated light beam for generating said particle beam by photoemission.

4. The system of claim 2 wherein said storing means comprises:

a cylindrical cavity coupled to said modulating means; and a structure disposed within said cylindrical cavity, said structure being comprised of a plurality of thin metallic discs selectively spaced along said cylindrical cavity;

said cylindrical cavity and said structure being geometrically configured to allow said radio frequency energy from said high power modulated intense relativistic electron beam from said modulating means to be stored therein.

5. The system of claim 4 wherein said producing means includes:

a laser that produces a light beam that is intensity modulated by said preselected frequency to produce a modulated light beam; and a point source coupled to said storing means and being responsive to said modulated light beam for generating said particle beam by photoemission.

6. The system of claim 4 wherein the internal diameter of said cylindrical cavity, the radius and thickness of said discs and the spacing between adjacent ones of said discs are geometric parameters which determine said preselected frequency.

7. The system of claim 6 wherein selected ones of said discs contain holes at the respective centers of said selected ones of said discs, said modulated particle beam being accelerated by said stored radio frequency energy as it drains this energy from said structure during its passage through said holes.

8. The system of claim 2 wherein said modulating means comprises:

a drift tube coupled to said generating means for enabling said high power intense relativistic electron beam to propagate thereinto:

inductive means surrounding said drift tube for supplying a strong axial magnetic field to confine said high power intense relativistic electron beam within said drift tube;

annular radio frequency cavity means around at least one portion of said drift tube for receiving a preselected frequency to which it is resonant;

circular gap means for interconnecting said cavity means into said drift tube; and radio frequency source means coupled to said cavity means for providing a signal at said preselected frequency to modulate said high power intense relativistic beam at said gap means to produce a high power modulated intense relativistic beam at said preselected frequency.

9. The system of claim 8 wherein said producing means includes:

a laser that produces a light beam that is intensity modulated by said preselected frequency to produce a modulated light beam; and a point source coupled to said storing means and being responsive to said modulated light beam for generating said particle beam by photoemission.

10. The system of claim 8 wherein said storing means comprises:

a cylindrical cavity coupled to said modulating means; and a structure disposed within said cylindrical cavity, said structure being comprised of a plurality of thin metallic discs selectively spaced along said cylindrical cavity;

said cylindrical cavity and said structure being geometrically configured to allow said radio frequency energy from said high power modulated intense relativistic electron beam from said modulating means to be stored therein.

11. The system of claim 10 wherein said producing means includes:

a laser that produces a light beam that is intensity modulated by said preselected frequency to produce a modulated light beam; and a point source coupled to said storing means and being responsive to said modulated light beam for generating said particle beam by photoemission.

12. The system of claim 10 wherein the internal diameter of said cylindrical cavity, the radius and thickness of said discs and the spacing between adjacent ones of said discs are geometric parameters which determine said preselected frequency.

13. The system of claim 10 wherein selected ones of said discs contain holes at the respective centers of said selected ones of said discs, said modulated particle beam being accelerated by said stored radio frequency energy as it drains this energy from said structure during its passage through said holes.

14. The system of claim 2 wherein said generating means is a diode responsive to a high voltage pulse for generating said high power intense relativistic electron beam.

15. The system of claim 14 wherein said producing means includes:

a laser that produces a light beam that is intensity modulated by said preselected frequency to produce a modulated light beam; and a point source coupled to said storing means and being responsive to said modulated light beam for generating said particle beam by photoemission.

16. The system of claim 14 wherein said storing means comprises:

a cylindrical cavity coupled to said modulating means; and a structure disposed within said cylindrical cavity, said structure being comprised of a plurality of thin metallic discs selectively spaced along said cylindrical cavity;

said cylindrical cavity and said structure being geometrically configured to allow said radio frequency energy from in said high power modulated intense relativistic electron beam from said modulating means to be stored therein.

17. The system of claim 16 wherein said producing means includes:

a laser that produces a light beam that is intensity modulated by said preselected frequency to produce a modulated light beam; and a point source coupled to said storing means and being responsive to said modulated light beam for generating said particle beam by photoemission.

18. The system of claim 16 wherein the internal diameter of said cylindrical cavity, the radius and thickness of said discs and the spacing between adjacent ones of said discs are geometric parameters which determine said preselected frequency.

19. The system of claim 16 wherein selected ones of said discs contain holes at the respective centers of said selected ones of said discs, said modulated particle beam being accelerated by said stored radio frequency energy as it drains this energy from said structure during its passage through said holes.

20. The system of claim 14 wherein said modulating means comprises:

a drift tube coupled to said generating means for enabling said high power intense relativistic electron beam to propagate thereinto;

inductive means surrounding said drift tube for supplying a strong axial magnetic field to confine said high power intense relativistic electron beam within said drift tube;

annular radio frequency cavity means around at least one portion of said drift tube for receiving a preselected frequency to which it is resonant;

circular gap means for interconnecting said cavity means into said drift tube; and radio frequency source means coupled to said cavity means for providing a signal at said preselected frequency to modulate said high power intense relativistic beam at said gap means to produce a high power modulated intense relativistic beam at said preselected frequency.

21. The system of claim 20 wherein said producing means includes:

a laser that produces a light beam that is intensity modulated by said preselected frequency to produce a modulated light beam; and a point source coupled to said storing means and being responsive to said modulated light beam for generating said particle beam by photoemission.

22. The system of claim 20 wherein said storing means includes:

a cylindrical cavity coupled to said modulating means; and a structure within said cylindrical cavity, said structure being comprised of a plurality of thin metallic discs selectively spaced along said cylindrical cavity, said discs selectively containing holes at the centers of said discs;

said cylindrical cavity and said structure being geometrically configured to allow said radio frequency energy from said high power modulated intense relativistic electron beam from said modulating means to be stored therein, and said modulated particle beam being accelerated by said stored radio frequency energy as it drains this energy from said structure during its passage through said holes in said storing means.

23. The system of claim 22 wherein said producing means includes:

a laser that produces a light beam that is intensity modulated by said preselected frequency to produce a modulated light beam; and a point source coupled to said storing means and being responsive to said modulated light beam for generating said particle beam by photoemission.

24. The system of claim 22 wherein the internal diameter of said cylindrical cavity, the radius and thickness of said discs and the spacing between adjacent ones of said discs are geometric parameters which determine said preselected frequency.

25. The system of claim 22 wherein selected ones of said discs contain holes at the respective centers of said selected ones of said discs, said modulated particle beam being accelerated by said stored radio frequency energy as it drains this energy from said structure during its passage through said holes.

26. The system of claim 25 wherein the internal diameter of said cylindrical cavity, the radius and thickness of said discs and the spacing between adjacent ones of said discs are geometric parameters which determine said preselected frequency.

* * * * *